US010216149B2

(12) United States Patent
Winkler et al.

(10) Patent No.: US 10,216,149 B2
(45) Date of Patent: Feb. 26, 2019

(54) PROTECTION FOR THE STRIPS OF A MECHANICAL WATCH RESONATOR

(71) Applicant: The Swatch Group Research and Development Ltd, Marin (CH)

(72) Inventors: Pascal Winkler, St-Blaise (CH); Jean-Luc Helfer, Le Landeron (CH); Dominique Lechot, Les Reussilles (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/793,145

(22) Filed: Oct. 25, 2017

(65) Prior Publication Data

US 2018/0136609 A1 May 17, 2018

(30) Foreign Application Priority Data

Nov. 16, 2016 (EP) ..... 16199012

(51) Int. Cl.
*G04B 17/10* (2006.01)
*G04B 43/00* (2006.01)
(Continued)

(52) U.S. Cl.
CPC ..... *G04B 43/002* (2013.01); *G04B 17/045* (2013.01); *G04B 17/10* (2013.01); *G04B 31/02* (2013.01)

(58) Field of Classification Search
CPC ..... G04B 17/045; G04B 17/04; G04B 17/26; G04B 17/10
See application file for complete search history.

(56) References Cited

U.S. PATENT DOCUMENTS 3,099,502 A * 7/1963 Bourquin ..... F16C 27/08 384/225
8,882,339 B2 * 11/2014 Colpo ..... G04B 15/06 368/127
(Continued)

FOREIGN PATENT DOCUMENTS

EP 3 035 126 A1 6/2016
EP 3 035 127 A1 6/2016
EP 3 054 356 A1 8/2016

OTHER PUBLICATIONS

Google Translate—claim1—google.com—Sep. 25, 2018.*
(Continued)

*Primary Examiner* — Sean Kayes
(74) *Attorney, Agent, or Firm* — Oblon, McClelland, Maier & Neustadt, L.L.P.

(57) ABSTRACT

Strip resonator for a mechanical watch movement, comprising a structure, an oscillating inertial element, and elastic strips forming a flat bearing for the inertial element, and a flat, anti-shock device arranged to protect each strip from rupture in the event of a shock, and including a first prestressed flexible element arranged to allow a variation in length during the expansion or contraction of a strip within a range of lengths corresponding to normal operation of this strip under the action of a stress of intensity lower than a first threshold, and to prevent the expansion or contraction of this strip when it is subjected to a tensile or respectively compressive stress of intensity higher than the first threshold, and the resonator includes, for the three-dimensional anti-shock protection of the strips, in an axial direction perpendicular to a main plane, axial protection means, which include, on the one hand, axial banking members for limiting the axial travel of at least one inertial element, and on the other hand, an axial anti-shock device comprising a second axially prestressed flexible element.

25 Claims, 8 Drawing Sheets

(51) Int. Cl.
*G04B 31/02* (2006.01)
*G04B 17/04* (2006.01)

(56) References Cited

U.S. PATENT DOCUMENTS

| | | | | |
|---|---|---|---|---|
| 9,477,205 | B2 * | 10/2016 | Born | G04B 17/045 |
| 9,625,880 | B2 * | 4/2017 | Girardin | G04B 31/02 |
| 9,733,621 | B2 * | 8/2017 | Lechot | G04B 31/04 |
| 9,983,549 | B2 * | 5/2018 | Winkler | G04B 17/045 |
| 2006/0187767 | A1 * | 8/2006 | Conus | G04B 31/04 368/324 |
| 2016/0179058 | A1 * | 6/2016 | Born | G04B 17/045 368/167 |
| 2017/0010586 | A1 | 1/2017 | Di Domenico et al. | |
| 2017/0123380 | A1 * | 5/2017 | Winkler | G04B 17/045 |

OTHER PUBLICATIONS

Google Translate—claims 2, 3—google.com—Sep. 25, 2018.*
European Search Report dated May 18, 2017 in European application 16199012.2, filed on Nov. 16, 2016 (with English Translation of Categories Cited).

* cited by examiner

PROTECTION FOR THE STRIPS OF A MECHANICAL WATCH RESONATOR

This application claims priority from European Patent Application No. 16199012.2 filed on Nov. 16, 2016, the entire disclosure of which is hereby incorporated herein by reference.

FIELD OF THE INVENTION

The invention concerns a strip resonator for a mechanical watch movement, arranged to be fixed to a plate of a movement or to form a plate, the resonator comprising a fixed structure, arranged to be fixed to the plate or to form the plate, and with respect to which fixed structure at least one inertial element is arranged to vibrate and/or oscillate, and the resonator including at least one resilient strip extending between, at a first end, a first anchorage arranged on the fixed structure and, at a second end, a second anchorage arranged on at least one inertial element, and the strip being arranged to vibrate essentially in a main plane.

The invention concerns the field of mechanical timepiece resonators.

BACKGROUND OF THE INVENTION

Most current mechanical watches use a balance/balance spring resonator as the time base. However, this device, proven for centuries, has pivots which rub against their bearing. Nowadays, micro-fabrication techniques make it possible to envisage replacing the balance/balance spring with a strip resonator. This makes it possible to eliminate friction from the pivots. Such a strip resonator is characterized by the fact that the strips fulfil both the bearing function and the elastic return force function. U.S. Pat. No. 9,207,641 in the name of CSEM presents such a resonator.

Unfortunately, in the event of a shock to the watch, the strips of the strip resonator, which are thin and slender, are liable to break.

EP Patent Application 3035127A1 by the same Applicant discloses a timepiece oscillator comprising a resonator formed by a tuning fork, which includes at least two mobile oscillating parts, fixed to a connection element by flexible elements whose geometry determines a virtual pivot axis of determined position with respect to a plate, and about which oscillates the respective mobile part, whose centre of mass coincides in the rest position with the respective virtual pivot axis. For at least one mobile part, these flexible elements are formed of crossed elastic strips at a distance from each other in two parallel planes, and whose directions, in projection onto one of said parallel planes, intersect at said virtual pivot axis of the mobile part.

EP Patent Application 3054356A1 by the same Applicant discloses a timepiece resonator comprising at least one weight oscillating with respect to a connection element fixed to a movement structure. This weight is suspended to the connection element by crossed elastic strips which extend at a distance from each other in two parallel planes, and whose projections onto one of the planes intersect on a virtual pivot axis of the weight, and define a first angle which is the vertex angle opposite which extends the portion of the connection element located between the attachments of the crossed strips to the connection element. This vertex angle is comprised between 68° and 76° for optimum isochronism.

SUMMARY OF THE INVENTION

It is an object of the present invention to propose a device for protecting the strips in the event of a shock. This device will be referred to hereinafter as an "anti-shock device".

To this end, the invention concerns a resonator according to claim 1.

The invention also concerns a timepiece movement including at least one such resonator.

The invention also concerns a watch including at least one such movement.

BRIEF DESCRIPTION OF THE DRAWINGS

Other features and advantages of the invention will appear upon reading the following detailed description, with reference to the annexed drawings, in which:

FIG. 24 illustrates a variant in which the axial travel of the inertial element is limited by banking discs forming axial banking members above and below the resonator, and a theoretical arrangement only suitable for certain types of strips, with mechanical banking members in proximity to the strips, above and below the resonator, forming axial protection means for the strips.

FIG. 25 illustrates the case where each strip includes an eye or a recess on the pivot axis for the passage of an arbor, fixed to the plate, and comprising banking discs similar to the mechanical banking members of FIG. 24; the arbor then also participates in the travel limiting function in the main plane.

FIG. 26 is a partial view of a variant of FIG. 25, in which the arbor is not rigidly fixed to the plate, but is suspended to a prestressed axial anti-shock device having compressive resistance torques, and clips, similar to those of FIGS. 10 to 13, for tensile resistance.

DETAILED DESCRIPTION OF PREFERRED EMBODIMENTS

Figure 1:
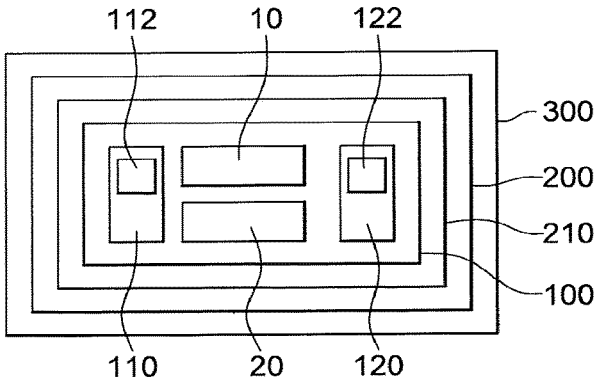
FIG. 1 is a block diagram representing a watch that includes a timepiece movement, which comprises a plate with a resonator, which in turn includes a structure and an inertial element fixed to this structure by at least one flexible elastic strip protected by an anti-shock device according to the invention.
Figure 2:
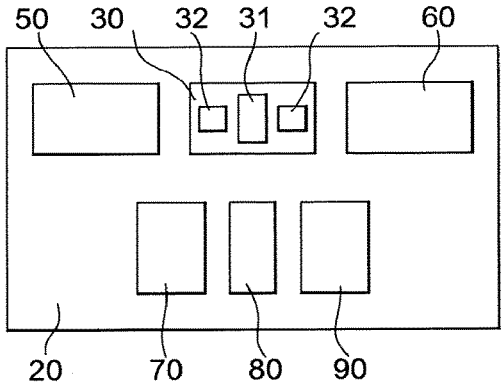
FIG. 2 is a block diagram representing this anti-shock device, which includes a base for attachment to the structure or to the inertial element or to the plate; said base carries, via an elastic suspension element, a shuttle to which is fixed a first end of a strip, and a prestressed flexible element formed by a prestressed spring clip comprising two clip heads cooperating in a complementary manner, one with a shuttle housing, the other with a structure housing, and stop means and banking means.
Figure 3:
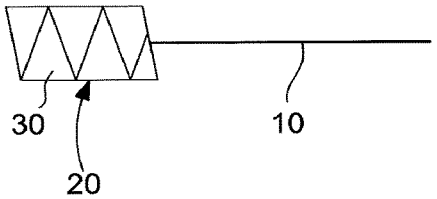
FIG. 3 represents a schematic view of a symbol created for the invention and used in the other Figures for simplification, representing this anti-shock device with its prestressed flexible element, and the strip that it carries.

The invention proposes to develop a timepiece, in particular a mechanical watch 300, including at least one strip resonator 100, comprising flexible elastic strips 10 effectively protected against shocks.

More particularly, and as illustrated in a non-limiting manner by the Figures, this strip resonator 100 is a rotating resonator.

Strips 10 fulfil the bearing function for the inertial element of the resonator and, according to the invention, they are protected from rupture in the event of shock by at least one flat, anti-shock device 20.

Shocks can exert stress in any direction in space, and the strip resonator of the invention includes means protecting the strips from stresses imparted thereto in the plane in which they are deformed in normal operation, referred to hereinafter as the main plane PP. In an advantageous variant of the invention, strip resonator 100 further includes means protecting the strips from stresses that are imparted thereto in an axial direction Z, perpendicular to this main plane PP. Advantageously, resonator 100 includes means of protection both in this plane PP, and in the axial direction. Thus, the strips can be protected against tensile, compressive and shearing stress.

In a particular and advantageous manner, strips 10 fulfil both the bearing function and the return stress function, i.e. return force and/or return torque, depending on the configuration of resonator 100, for inertial element 120 of the resonator, or the inertial elements when the resonator includes several.

More particularly, the invention concerns a strip resonator 100 for a mechanical movement 200 of a watch 300.

This resonator 100 is arranged to be fixed to a plate 210 of such a movement 200, or to form such a plate 210.

Resonator 100 includes a structure 110, in particular but not limited to a fixed structure, which is arranged to be fixed to plate 210 or to form plate 210.

At least one inertial element 120 is arranged to vibrate and/or oscillate with respect to this structure 110.

Resonator 100 includes at least one elastic strip 10, which extends between, at a first end 11, a first anchorage 1 arranged on structure 110, and at a second end 12, a second anchorage 2 arranged on at least one inertial element 120. Naturally, the connection between structure 110 and an inertial element 120 may be ensured by a plurality of strips, or by a plurality of strips between which intermediate weights are arranged, such as, for example, in flexible pivots with four V-shaped pivots mounted head-to-tail, or analogue. In such case, the notion of a "strip" covers the whole assembly inserted between structure 110 and the inertial element 120 concerned, at least one element of which is such a flexible strip.

Such an elastic strip 10 is arranged to vibrate essentially in a main plane PP.

This at least one strip 10 forms a bearing for inertial element 120 with which it cooperates, in main plane PP.

More particularly, resonator 1000 includes a plurality of such strips 10.

According to the invention, for the anti-shock protection of the strips 10 comprised therein, resonator 1000 includes, on first anchorage 1 and/or second anchorage 2, at least one flat anti-shock device 20, which is arranged to protect each at least one strip 10 against rupture in the event of a shock. To this end, this flat, anti-shock device 20 includes at least a first prestressed flexible element 30, pretensioned with a prestressing force in main plane PP, which is set at a predetermined safe stress value. More particularly, flat, anti-shock device 20 includes at least one prestressed elastic part. Advantageously, it is completed by at least one banking member, capable of limiting the travel of the strip or of the inertial element.

Flat, anti-shock device 20 advantageously includes at least a first prestressed flexible element 30, which is arranged to allow a variation in length during the expansion or contraction of at least one strip 10 within a range of lengths Lmin-Lmax corresponding to the normal operation of strip 10 under the action of a stress of intensity lower than a threshold S, and to prevent the expansion or contraction of the at least one strip 10 outside the first range of lengths Lmin-Lmax when strip 10 is subjected to a tensile or respectively compressive stress of intensity higher than threshold S.

Figure 4:
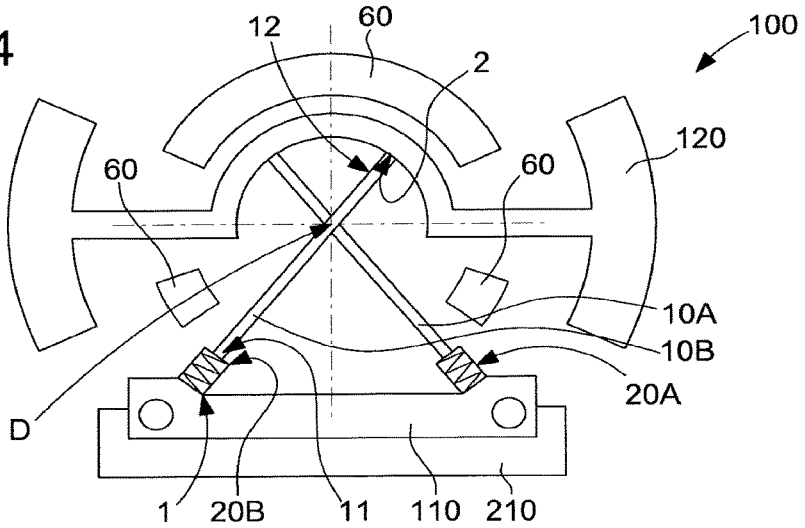
FIG. 4 represents a schematic, plan view of a mechanical resonator with two crossed strips disposed in parallel and distant planes, each strip being connected to the structure by an anti-shock device according to the invention.
Figure 5:
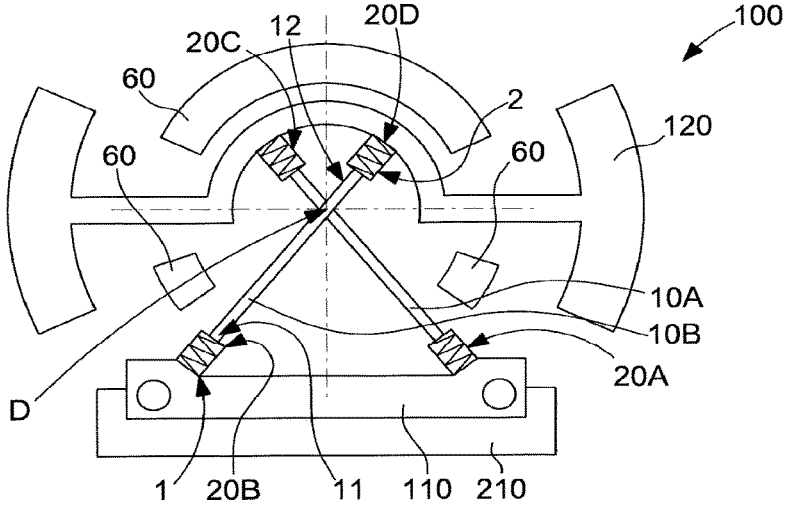
FIG. 5 represents, in a similar manner to FIG. 4, a variant of this mechanical resonator, wherein each strip is connected, at one end thereof, to the structure by an anti-shock device according to the invention, and at the other end to the inertial element by an anti-shock device according to the invention.

In a particular embodiment, as seen in FIG. 4 or 5, the prestressed elastic part is placed between the resonator support and the inertial element of the resonator, and the banking members are integral with the support and act on the inertial element of the resonator.

Figure 6:
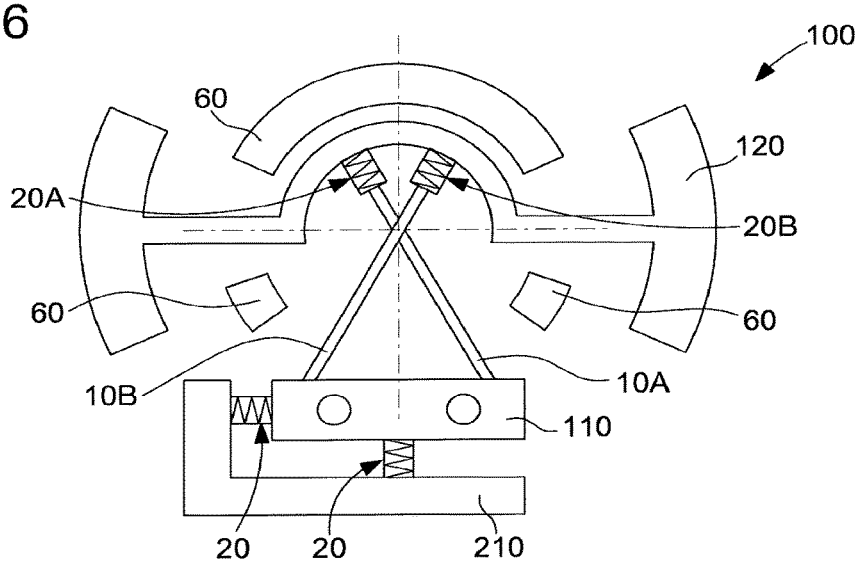
FIG. 6 represents, in a similar manner to FIG. 5, another variant of this mechanical resonator, wherein each strip is connected, at one end, to the inertial element by an anti-shock device according to the invention, and wherein the resonator structure is fixed to the plate by two anti-shock devices according to the invention, in two perpendicular directions.
Figure 7:
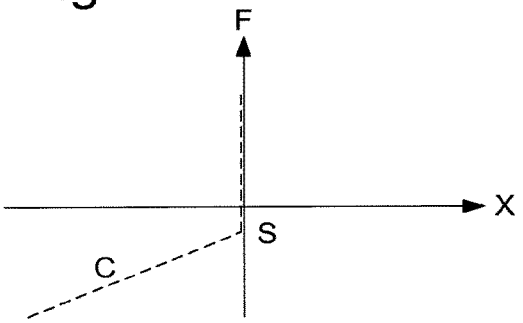
FIG. 7 is a force as a function of the travel diagram, showing the protection of a strip against the rupture under compression by means of a prestressed elastic part of the anti-shock device.
Figure 8:
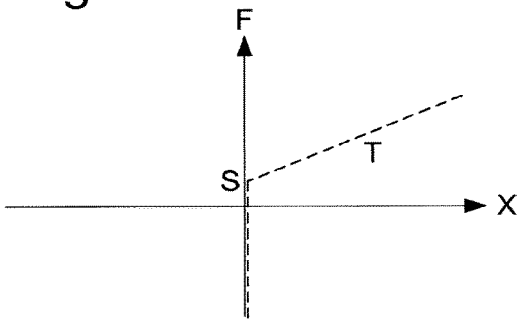
FIG. 8 is a force as a function of the travel diagram, showing the protection of a strip against the rupture under tension by means of a prestressed elastic part of the anti-shock device.
Figure 9:
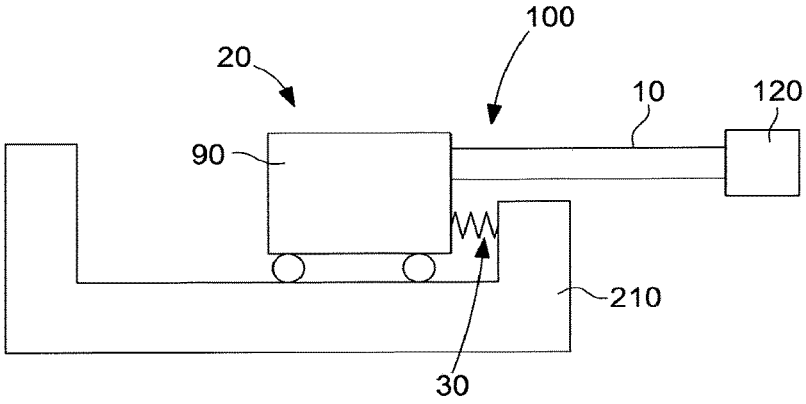
FIG. 9 is a schematic diagram showing a shuttle carrying a strip which is mobile with respect to the plate and subjected to the action of a prestressed elastic part of the anti-shock device.
Figure 10:
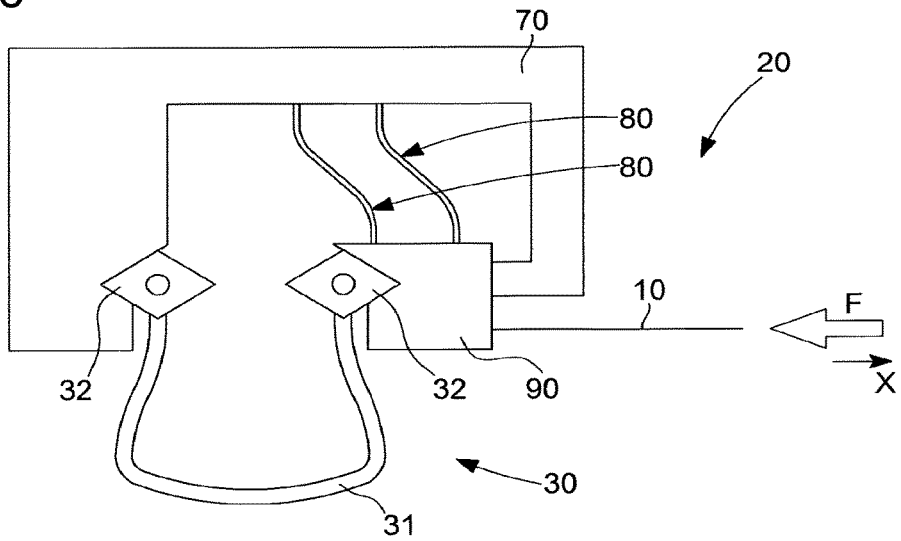
FIG. 10 represents a schematic, plan view of the detail of an anti-shock device according to the invention, in the operating position, with a strip carrier shuttle suspended by parallel elastic elements to the base, the shuttle being pressed onto the base by a prestressed elastic part, for protection of the strip under compressive stress, formed by a U-shaped clip having two heads, with one housed abutting on the base and the other on the shuttle.
Figure 11:
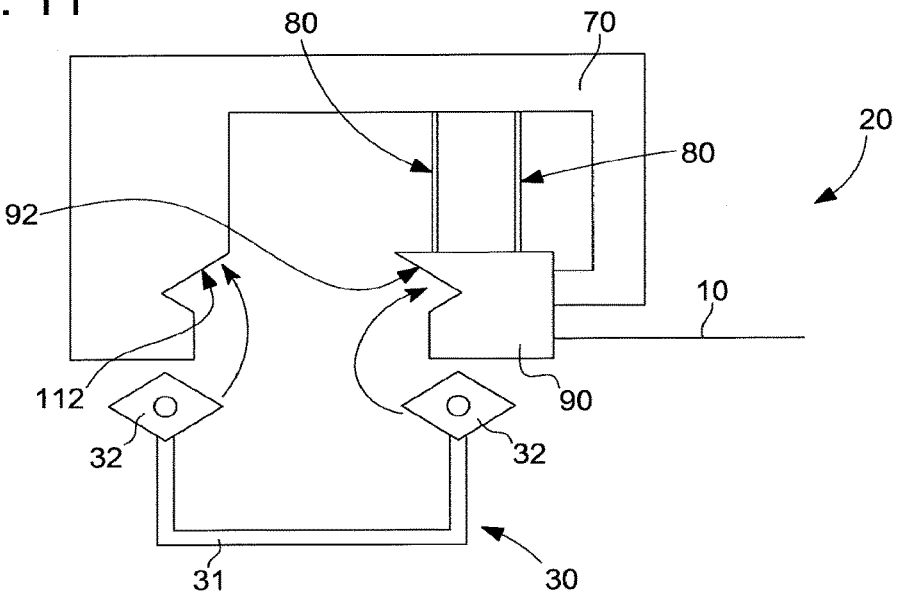
FIG. 11 represents the same device prior to assembly, with the shuttle suspended in the free state, and the clip in its deployed, free position.
Figure 12:
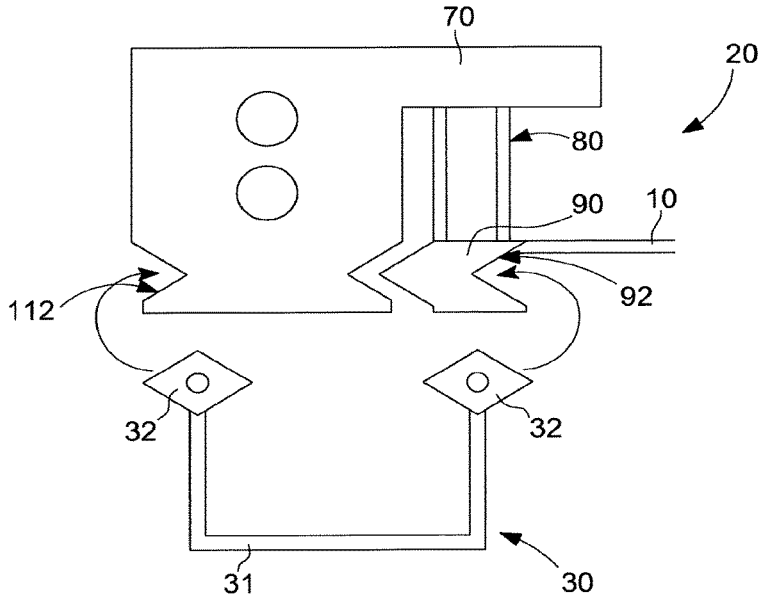
FIG. 12 represents, in a similar manner to FIG. 11, the detail of an anti-shock device according to the invention, prior to assembly, the prestressed elastic part being devised this time for protection of the strip under tension.
Figure 13:
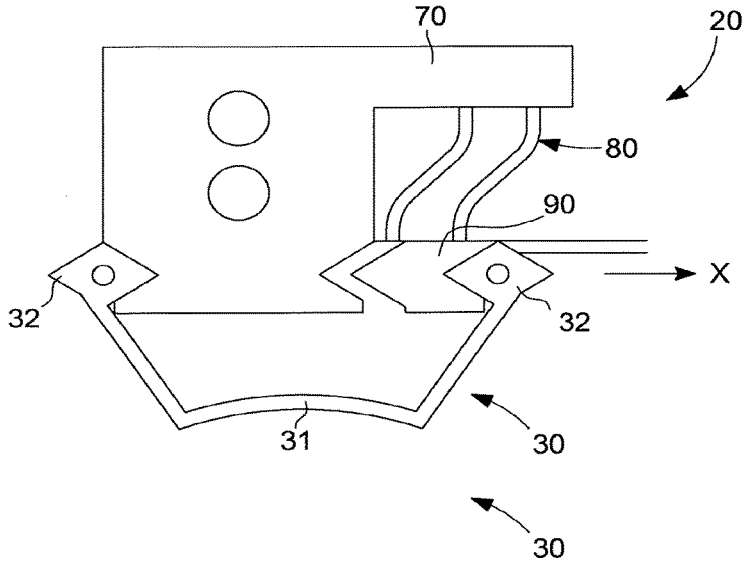
FIG. 13 shows this anti-shock device in the operating position, with the clip gripping both the base and the shuttle.

In another particular embodiment, as seen in FIG. 6, the prestressed elastic part is placed between the resonator support and the plate, and the banking members are integral with the plate and act on the inertial element of the resonator.

Advantageously, at least one of the prestressed elastic parts is arranged to protect at least one of the strips from rupture under compression.

Advantageously, at least one of the prestressed elastic parts is arranged to protect at least one of the strips from rupture under tension.

Figure 17:
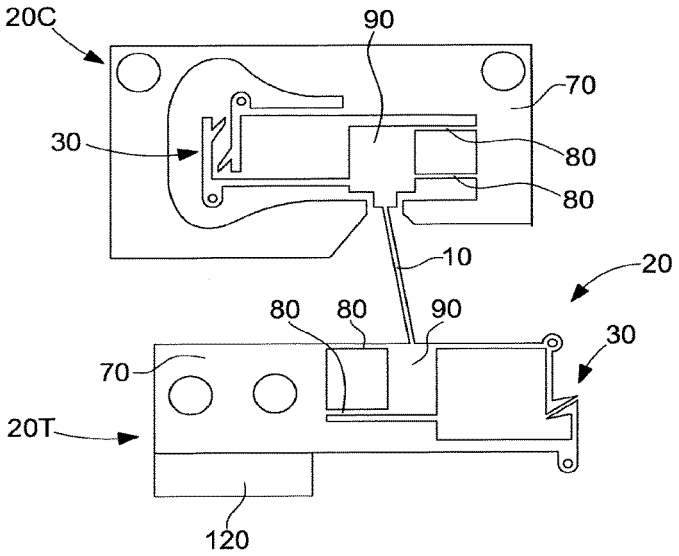
FIG. 17 represents a schematic, plan view, of a detail of a resonator according to the invention, in the free state prior to activation with a strip represented on the diagonal and protected by two anti-shock devices, one including a prestressed elastic part for protection of the strip under compressive stress, and the other including a prestressed elastic part for protection of the strip under tensile stress, each of these elastic parts being in two portions and comprising hooks arranged for securing the two portions and for pretensioning the strip.
Figure 18:
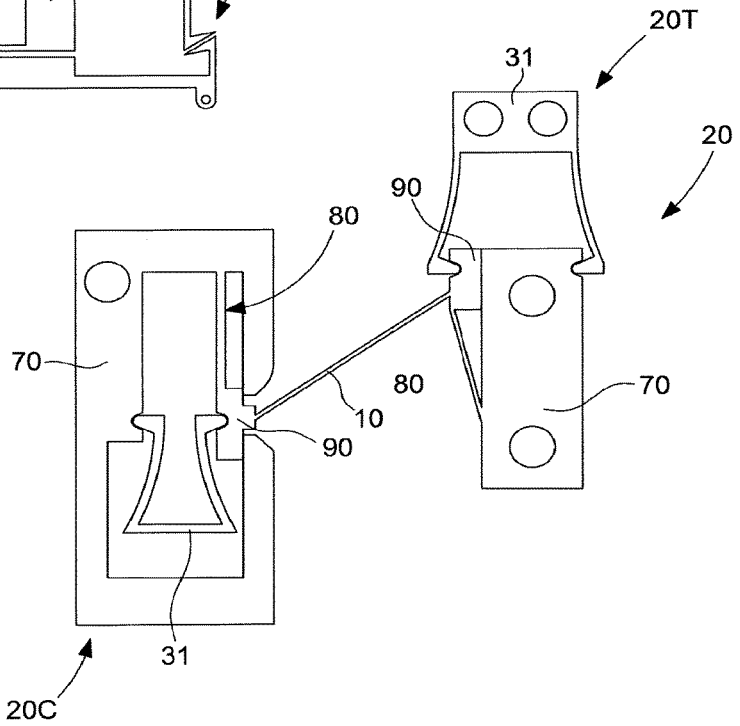
FIG. 18 represents a device similar to that of FIG. 17, and in which the anti-shock devices are similar to those of FIGS. 10-11 and 12-13.
Figure 19:
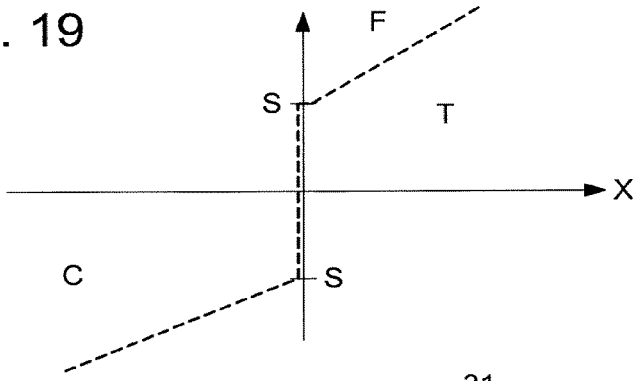
FIG. 19 is a stress as a function of the travel diagram showing the protection of a strip against rupture under both compression and tension, in each case by means of a prestressed elastic part of a suitable anti-shock device, as represented in FIG. 17 or 18.
Figure 20:
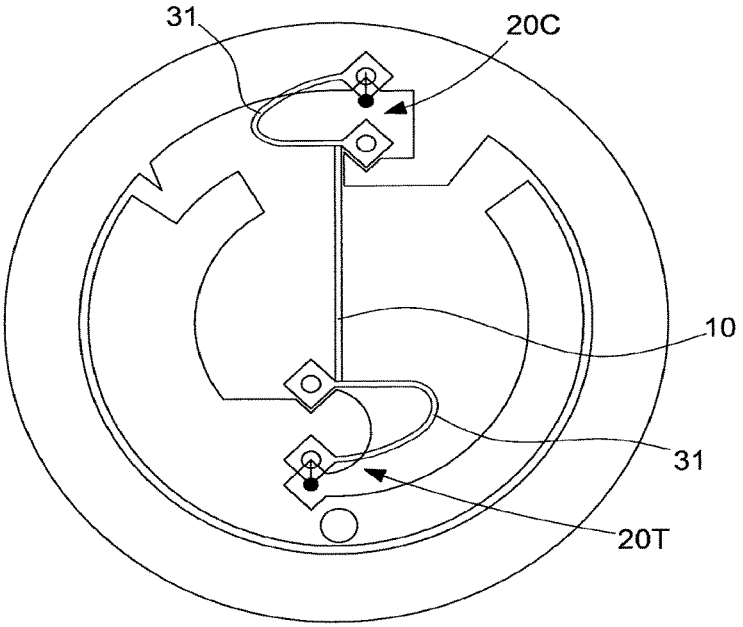
FIG. 20 represents a schematic, plan view, in the free state prior to tensioning, of a detail of a circular resonator according to the invention, with a strip in the median portion, and, attached to the ends of this strip, two prestressed elastic clip-shaped parts, similar to those of FIGS. 10 to 13, represented in superposition in the free state, prior to being prestressed inside their respective housings.

More particularly, and as seen in FIGS. 17, 18 and 20, at least one strip 10, and more particularly still each strip 10, is protected both by a first flat, anti-shock device 20T arranged for protection of said strip against tensile stress, and by a second flat anti-shock device 20C arranged for protection against compressive stress.

In a particular embodiment, in addition to its bearing function, at least one strip 10, and more particularly each strip 10, is arranged to exert a stress returning an element 120 towards a neutral position of the latter.

In a particular embodiment, as seen in FIG. 5, flat, anti-shock device 20 includes at least a first prestressed flexible element 30 at a first anchorage 1 and at least a first prestressed flexible element 30 at second anchorage 2.

In a particular embodiment, flat, anti-shock device 20 includes at least one stop 50, which is arranged to limit the travel of first end 11 or of second end 12 of the strip 10 concerned, and/or includes at least one banking member 60 arranged to limit the travel of the at least one inertial element 120.

Figure 14:
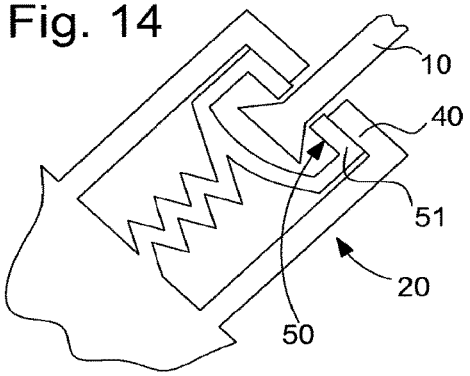
FIG. 14 represents a schematic, side view of a detail of the anti-shock device comprising a frame with an inner wall that forms a stop for a shell gripping the end of a strip, this shell, drawn by a spring, being in turn arranged to form a stop for an end of the strip that is conical or has oblique faces.
Figure 15:
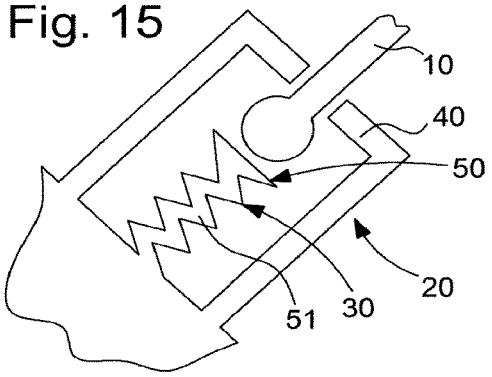
FIG. 15 is a similar view, in which a spring contained in the frame pushes back the end of a strip, which is stopped by an inner wall of the frame.

In a particular embodiment, as seen in FIG. 14 or 15, at least one first flexible prestressed element 30 is enclosed within a frame 40 including or forming a stop 50.

Figure 16:
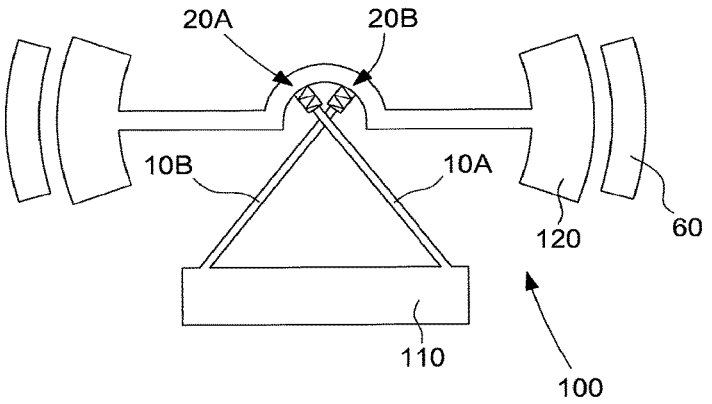
FIG. 16 is a similar view to FIG. 4, in which the crossed flexible strips of the resonator each carry an anti-shock device at the end of said strips joining the inertial element, which is externally surrounded by additional banking members.

In a particular embodiment, as seen in FIG. 4, 5 or 16, the at least one first prestressed flexible element 30 is placed between structure 110 and an inertial element 120, and flat, anti-shock device 20 includes at least one banking member 60 integral with structure 110 and arranged to limit the travel of at least one inertial element 120.

In another particular embodiment, as seen in FIG. 6, structure 110 is separate from plate 210 and first prestressed flexible element 30 is placed between structure 110 and plate 210, and flat, anti-shock device 20 includes at least one banking member 60 integral with plate 120 and arranged to limit the travel of the at least one inertial element 120.

Particular embodiments of first prestressed flexible elements 30 can be seen in FIGS. 10 to 13: the first prestressed elastic part includes a base, a shuttle for attaching the strip and a prestressed spring. This particular flat, anti-shock device 20 includes a base 70, which is arranged to be fixed to structure 110, or to an inertial element 120, or to plate 210. This base 70 carries, via at least one elastic suspension element 80, a shuttle 90 to which is fixed the first end 11 or second end 12 of a strip 10, and includes at least one first prestressed flexible element 30 formed by a prestressed spring clip 31 comprising two clip heads 32. The clip heads are arranged to cooperate in a complementary manner, one with a shuttle housing 92, and the other with a structure housing 112 comprised in structure 110 or an inertial element 120 or plate 210, in a tensile or compressive stressed state of clip 31.

In a first variant, at least one of the prestressed elastic parts is arranged to protect at least one of the strips from rupture under compression.

In a second variant, at least one of the prestressed elastic parts is arranged to protect at least one of the strips from rupture under tension.

Advantageously, the resonator includes means for protecting its strips from both compressive and tensile stress, and at least one of the strips is protected from tensile and compressive rupture by one of the prestressed elastic parts of an anti-shock device, respectively another of the prestressed elastic parts of an anti-shock device, particularly but not necessarily of another anti-shock device. More particularly, the bases, prestressed springs, the attachment shuttles and the strips are made in one piece.

In a particular embodiment, as seen in FIG. 18, base 70 and shuttle 90 for attaching strip 10 are in one piece.

In a particular embodiment, as seen in FIG. 17, base 70, shuttle 90 for attaching strip 10, and clip 31 are in one piece.

More particularly, this single piece is made of silicon, or of silicon and silicon dioxide.

More particularly, at least some of strips 10, or more particularly all of the strips, are made of silicon, temperature compensated with a surface layer of silicon dioxide. More particularly, this surface layer has a thickness comprised between 2.5 and 3.0 micrometers.

In another variant, the strips are made of amorphous metal or metallic glass.

In a particular embodiment, resonator 100 comprises a one-piece component 25 which unites all the bases 70, all the shuttles 90 and all the clips 31 comprised in the flat, anti-shock devices 20 contained in resonator 100.

In a particular embodiment, this one-piece component 25 is made of silicon.

Advantageously, when resonator 100 includes banking members 60, at least one of the latter is placed at the centre of rotation of inertial element 120 so that, in the event of a shock, the disruptive torque is minimal.

Figure 21:
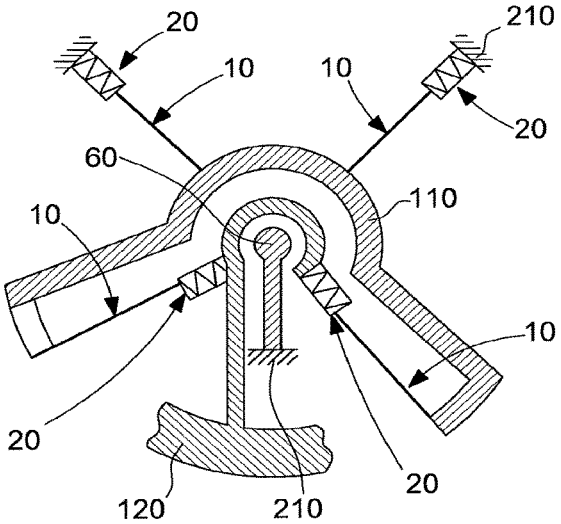
FIG. 21 represents a schematic, plan view of a detail of a resonator according to the invention, in which the anti-shock device and the bearing strips are achieved by the combination of two V-shaped pivots mounted head-to-tail and a banking member.

In a particular variant of the resonator, as seen in FIG. 21, resonator 100 includes a flat, anti-shock device 20 and strips 10, which are arranged to form two V-shaped pivots mounted head-to-tail, in combination with a fixed banking member 60 comprised in structure 110 or an inertial element 120 or plate 210, placed at the centre of rotation of inertial element 120. In such case, prestressing is not required to create a threshold effect. The threshold effect is created by the fact that, whatever the direction of the shock, one of the pivot strips can buckle to limit tensile stress in the strip located opposite.

In a particular, so-called crossed strip resonator variant, and as seen in FIGS. 4, 5, 6, 16, 22, 23, the resonator includes a plurality of strips 10, which together form a pivot with crossed strips.

Figure 22:
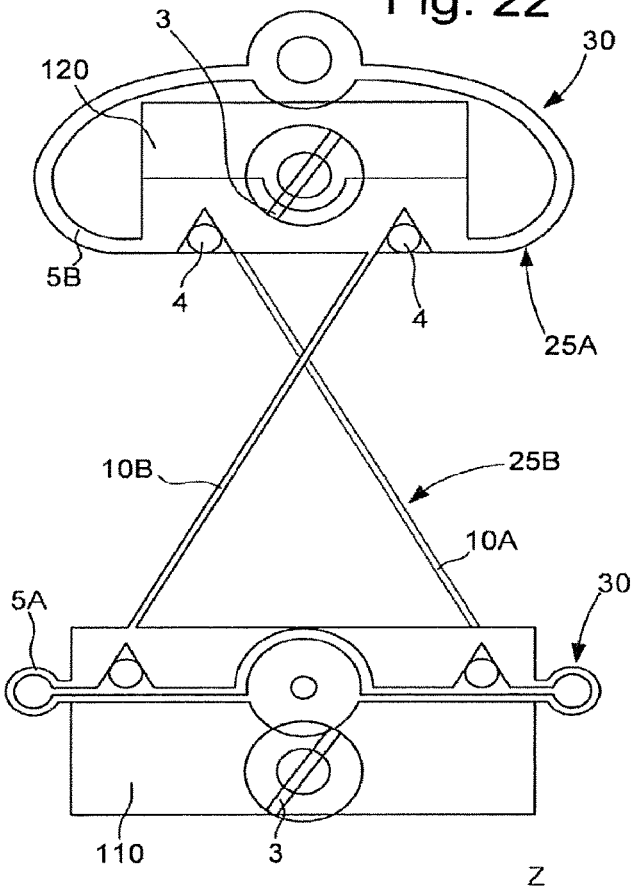
FIGS. 22 and 23 represent schematic, respectively plan and side views of a detail of another resonator according to the invention, which includes two crossed strips in parallel and distant planes, each protected by an anti-shock device according to the invention, and in which each level includes, in a single piece, a strip, a prestressed elastic element, and positioning supports for the strips.
Figure 23:
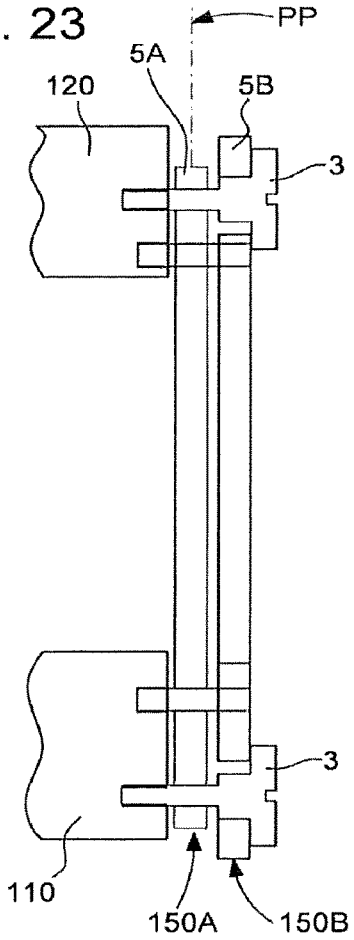

In the particular variant of FIGS. 22 and 23, this crossed strip pivot is formed of two levels 150, corresponding to cut-out plates, and each level 150 includes, in one piece, a strip 10, a prestressed elastic element, with a first prestressed flexible element 30, and positioning supports 160 for the strips.

More particularly, and in addition to this flat protection, for the three-dimensional anti-shock protection of the strips 10 comprised therein, resonator 100 also advantageously includes, in an axial direction Z perpendicular to main plane PP, axial protection means 400.

These axial protection means 400 either comprise axial banking members 401, 401A, 401B, or at least one axial anti-shock device 402.

More particularly, axial banking members 401, 401A, 401B, are banking members limiting the axial travel of at least one inertial element 120, and/or at least one strip 10.

Preferably, these axial banking members 401, 401A, 401B are axial travel limiting members which are arranged to abuttingly engage with one surface of an inertial element 120, or of an element added to an inertial element, such as a disc or similar, particularly a transparent disc making it possible to view the state of strips 10.

Indeed, direct cooperation of axial banking members with strips 10 is theoretically possible, but difficult to implement in practice when strips 10 are made of silicon or a similar material and, although protected from the shock, may be damaged by other contact stresses, which explains the preference for axial banking members arranged to cooperate with the inertial element. Such an arrangement may, however, be used in the event that conventional steel or similar strip springs are utilised.

Figure 24:
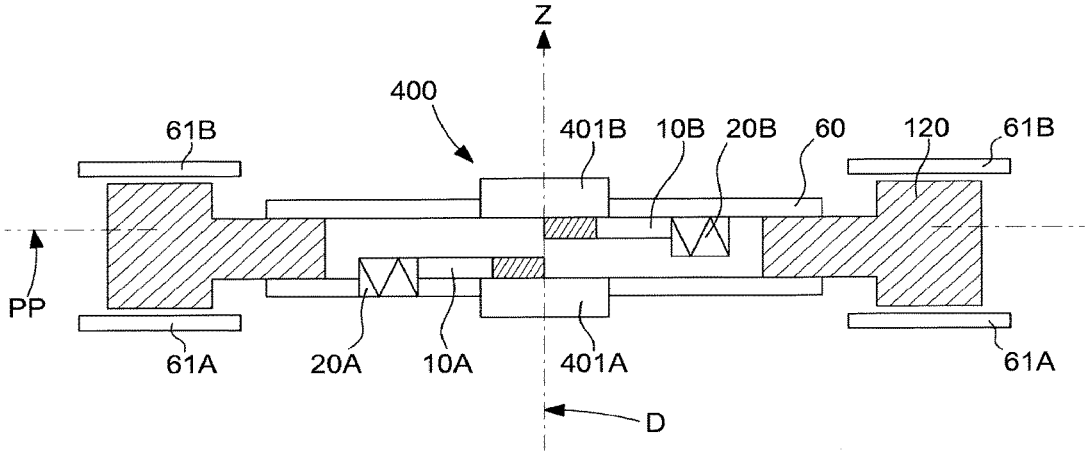

FIG. 24 illustrates a variant wherein the axial travel of inertial element 120 is limited by banking discs 61A and 61 B forming axial banking members above and below the resonator, and a theoretical arrangement only suitable for certain types of strips with mechanical banking members 401A and 401B in proximity to strips 10, above and below the resonator, forming axial protection means for the strips.

Figure 25:
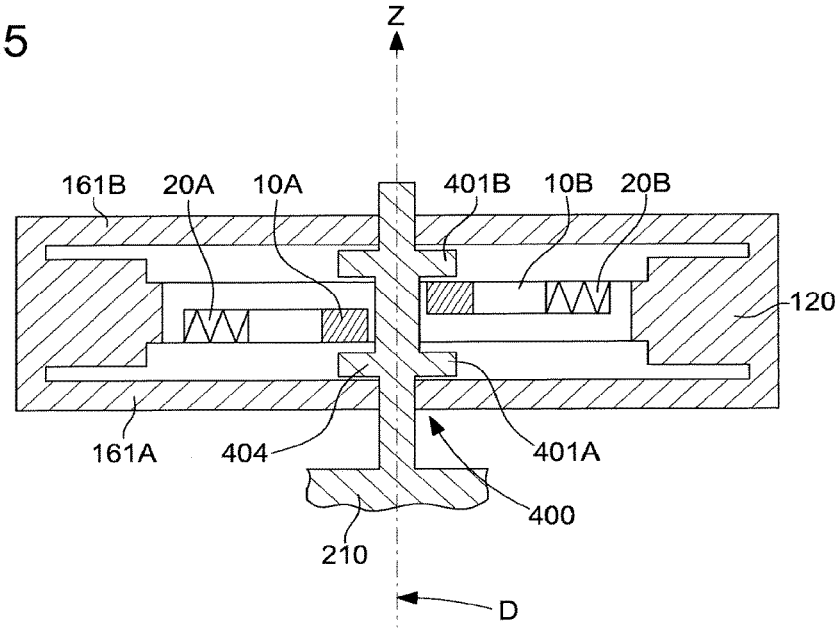

FIG. 25 illustrates a variant better suited to strips 10 made of silicon or micro-machinable material, metallic glass, or similar, wherein each strip 10A, 10B includes an eye or a recess on the pivot axis, for the passage of an arbor, fixed to plate 210, and which includes static banking discs 401 and 401B, which are arranged to abuttingly engage with mobile banking discs 161A and 161B integral with inertial element 120, whereas strips 10A and 10B are arranged to remain at a distance from static banking discs 401 and 401B when the latter are in contact with mobile banking discs 161A and 161B. The arbor then participates in the travel limiting function in the main plane.

More particularly, axial anti-shock device 402 includes a second axially prestressed flexible element 403.

Figure 26:
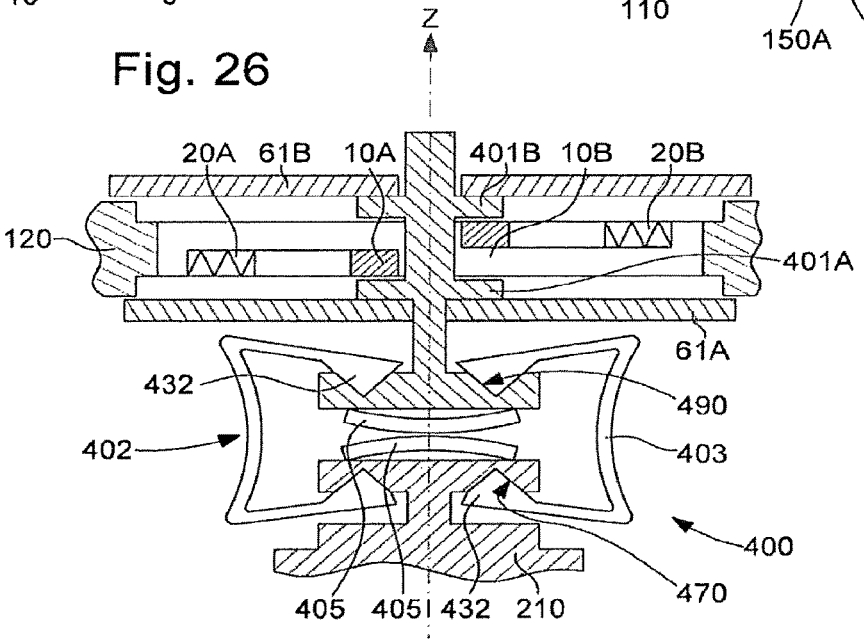
FIGS. 24 to 26 represent schematic cross-sectional views, along a plane through the pivot axis of the inertial element, of anti-shock protection means on the axial component parallel to this pivot axis.

Thus, FIG. 26 is a variant of FIG. 25, wherein the arbor that carries static banking discs 401 and 401B is not rigidly fixed to plate 210, but is suspended to a prestressed axial anti-shock device 402 having compression resistance torques, and clips, similar to those of FIGS. 10 to 13, for tension resistance. The prestressed spring clip includes clip heads 432 arranged to cooperate in a complementary manner, one with an arbor shuttle housing 490, and the other with a fixed structure housing 470 comprised in plate 120, springs 405 being inserted between a lower face of the arbor, and an upper face of a mushroom-shaped element comprised in plate 210, these springs 405 exerting a repelling force tending to resist the return force of clips 403. As in FIG. 25, the arbor includes static banking discs 401 and 401B, arranged to abuttingly engage with mobile banking discs 161A and 161B arranged to be fixed to inertial element 120, whereas strips 10A and 10B are arranged to remain at a distance from static banking discs 401 and 401B when the latter are in contact with these mobile banking discs 161A and 161B.

In an advantageous variant, resonator 100 includes, in axial direction Z, axial protection means 400 which comprise, on the one hand, axial banking members 401, 401A, 401B for limiting the axial travel of at least one inertial element 120, and/or of at least one strip 10, and on the other hand, at least one such axial anti-shock device 402 comprising a second axially prestressed flexible element 403. More particularly, resonator 100 includes, in axial direction Z, axial protection means 400 which include, on the one hand, axial banking members 401, 401A, 401B for limiting the axial travel of at least one inertial element 120, and on the other hand, at least one such axial anti-shock device 402 comprising a second axially prestressed flexible element 403.

The invention also concerns a timepiece movement 200 including at least one such resonator 100.

In a particular embodiment, this movement 200 includes two rotating resonators 100, which are mounted in a tuning fork arrangement to cancel out reaction forces on plate 210.

In another particular embodiment, movement 200 includes three rotating resonators 100 mounted at 120° and with a phase shift of one third of their period.

The invention also concerns a watch 300 including at least one movement 200 of this type.

The invention provides numerous advantages, and in particular excellent protection against shocks.

When using a first prestressed flexible element cooperating with a shuttle, the mobility of the shuttle avoids breakage of the strips (by compliance).

Prestressing is necessary so that the stiffness of the strips in the "no shock" mode is not affected.

Producing a single silicon part machined by DRIE or similar, avoids tedious assembly operations.

What is claimed is:

1. A strip resonator for a mechanical movement of a watch arranged to be fixed to a plate of said movement or to form said plate, said resonator including a structure, arranged to be fixed to said plate or to form said plate, and with respect to which structure at least one inertial element is arranged to vibrate and/or to oscillate, and said resonator including at least one elastic strip extending between, at a first end, a first anchorage arranged on said structure, and at a second end, a second anchorage arranged on said at least one inertial element, and said strip being arranged to vibrate essentially in a main plane, wherein said at least one strip forms a bearing for said inertial element in said main plane, and wherein, for the anti-shock protection of said strips comprised therein, said resonator includes, on said first anchorage and/or on said second anchorage, at least one flat anti-shock device, arranged to protect each said at least one strip against rupture in the event of a shock, said flat, anti-shock device including at least a first prestressed flexible element, pretensioned with a prestressing force in said main plane, set at a predetermined safe stress value, wherein, for the three-dimensional anti-shock protection of said strips comprised therein, said resonator includes, in an axial direction perpendicular to said main plane, axial protection means, which include, axial banking members for limiting the axial travel of at least one inertial element, and an axial anti-shock device comprising a second axially prestressed flexible element.

2. The resonator according to claim 1, wherein said flat, anti-shock device includes at least a first prestressed flexible element arranged to allow a variation in length during the expansion or contraction of said at least one strip within a first range of lengths corresponding to normal operation of said at least one strip under the action of a stress of intensity lower than a threshold, and to prevent the expansion or contraction of said at least one strip outside said first range of lengths (Lmin;

Lmax) when said strip is subjected to a tensile or respectively compressive stress of intensity higher than said threshold.

3. The resonator according to claim 1, wherein each said strip is protected both by a first said flat, anti-shock device arranged for protection against tensile stress, and by a second said flat, anti-shock device arranged for protection against compressive stress.

4. The resonator according to claim 1, wherein each said strip is arranged to exert a force returning said at least one inertial element towards a neutral position thereof.

5. The resonator according to claim 4, wherein said structure is distinct from said plate, and wherein said at least one prestressed flexible element is placed between said structure and said plate, and wherein said flat, anti-shock device includes at least one banking member integral with said plate and arranged to limit the travel of said at least one inertial element.

6. The resonator according to claim 1, wherein said strip resonator is a rotating resonator.

7. The resonator according to claim 1, wherein said flat, anti-shock device includes at least a first prestressed flexible element at said first anchorage and another first prestressed flexible element at said second anchorage.

8. The resonator according to claim 1, wherein said flat, anti-shock device includes at least one stop, arranged to limit the travel of said first end or of said second end, and/or at least one banking member arranged to limit the travel of said at least one inertial element.

9. The resonator according to claim 8, wherein at least one said first prestressed flexible element is enclosed in a frame including or forming said at least one stop.

10. The resonator according to claim 8, wherein said at least one first prestressed flexible element is placed between said structure and said at least one inertial element, and wherein said flat, anti-shock device includes at least one banking member integral with said structure and arranged to limit the travel of said at least one inertial element.

11. The resonator according to claim 10, wherein said at least one said banking member is placed at the centre of rotation of said inertial element in order to minimise disruptive torque in the event of a shock.

12. The resonator according to claim 1, wherein said at least one flat, anti-shock device includes a base, which is arranged to be fixed to said structure or to said at least one inertial element or to said plate, said base carrying, by means of at least one elastic suspension element, a shuttle to which is fixed said first end or said second end of said at least one strip, and includes at least one said first prestressed flexible element formed by a prestressed spring clip comprising two clip heads arranged to cooperate in a complementary manner, one with a shuttle housing, and the other with a structure housing comprised in said structure or said at least one inertial element or said plate, in a tensile or compressive stressed state of said clip.

13. The resonator according to claim 12, wherein said base and said shuttle for attachment of said strip are in one piece.

14. The resonator according to claim 13, wherein said base, said shuttle for attachment of said strip and said clip are in one piece.

15. The resonator according to claim 12, wherein said resonator comprises a one-piece component which unites all said bases, all said shuttles and all said clips comprised in the flat, anti-shock devices contained in said resonator.

16. The resonator (according to claim 15, wherein said one-piece component is made of silicon.

17. The resonator according to claim 1, wherein each strip comprised in said resonator is made of temperature compensated silicon.

18. The resonator according to claim 10, wherein each strip comprised in said resonator is made of amorphous metal.

19. The resonator according to claim 1, wherein said resonator includes said flat, anti-shock device and said strips arranged to form two V-shaped pivots mounted head-to-tail, and in combination with a fixed banking member comprised in said structure or said at least one inertial element or said plate, placed at the centre of rotation of said inertial element.

20. The resonator according to claim 1, wherein said resonator includes a plurality of said strips together forming a crossed strip pivot.

21. The resonator according to claim 20, wherein said crossed strip pivot includes at least two levels, each comprising, in one piece, said strip, a first prestressed flexible element, and positioning supports for said strips.

22. A timepiece movement including at least one resonator according to claim 1.

23. The timepiece movement according to claim 22, wherein said movement includes two said rotating resonators mounted in a tuning fork arrangement to cancel out reaction forces on said plate.

24. The timepiece movement according to claim 22, wherein said movement includes three said rotating resonators mounted at 120° and phase shifted by one third of a period.

25. A watch including at least one movement according to claim 22.

* * * * *